US011230782B2

(12) United States Patent
Lee et al.

(10) Patent No.: US 11,230,782 B2
(45) Date of Patent: Jan. 25, 2022

(54) PASSIVATION SURFACE TREATMENT OF STAINLESS STEEL

(71) Applicant: SAMSUNG ELECTRONICS CO., LTD., Suwon-si (KR)

(72) Inventors: Kyung Hwan Lee, Suwon-si (KR); Young Min Yoo, Seoul (KR); Young Deog Koh, Seongnam-si (KR); Kwang Joo Kim, Seoul (KR); Beom Gon Kim, Yongin-si (KR); Hyun Seok Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 15/984,853

(22) Filed: May 21, 2018

(65) Prior Publication Data

US 2019/0203371 A1 Jul. 4, 2019

(30) Foreign Application Priority Data

Jan. 4, 2018 (KR) ..... 10-2018-0001158

(51) Int. Cl.
*C25D 5/36* (2006.01)
*C25F 1/06* (2006.01)
(Continued)

(52) U.S. Cl.
CPC ..... *C25D 5/36* (2013.01); *C25D 11/38* (2013.01); *C25F 1/06* (2013.01); *C25D 5/50* (2013.01)

(58) Field of Classification Search
CPC ..... C25D 11/38; C25D 5/36
See application file for complete search history.

(56) References Cited

U.S. PATENT DOCUMENTS 2,330,608 A * 9/1943 Nachtman ..... C23F 4/00 205/206
2,375,613 A * 5/1945 Batcheller ..... C25D 11/34 205/665
(Continued)

FOREIGN PATENT DOCUMENTS

CN 107502901 A * 12/2017
GB 683638 A * 12/1952 ..... C23G 1/025
(Continued)

OTHER PUBLICATIONS

Li, Machine Translation, CN-107502901-A (Year: 2017).*
(Continued)

*Primary Examiner* — Ho-Sung Chung
(74) *Attorney, Agent, or Firm* — Staas & Halsey

(57) ABSTRACT

A passivation surface treatment method of stainless steel that improves corrosion resistance including in a brine environment without changing the appearance of the surface of stainless steel. A passivation surface treatment method for stainless steel includes: performing degreasing of stainless steel, performing electrolytic pickling where the stainless steel that underwent the degreasing is immersed in a pickling solution having phosphoric acid ($H_3PO_4$) and is connected to the anode and a voltage of about 0.5 to 5.0 V for about 10 seconds or more is applied, performing electrolytic degreasing of the stainless steel, and performing electrolytic passivation where the stainless steel that underwent the electrolytic degreasing is immersed in a passivation solution including dichromic acid and chromium sulfate and a voltage of about 0.5 to 5.0 V is applied for 5 seconds or more.

12 Claims, 11 Drawing Sheets

(51) Int. Cl.
*C25D 11/38* (2006.01)
*C25D 5/50* (2006.01)

(56) References Cited

U.S. PATENT DOCUMENTS 3,407,129 A * 10/1968 Petrocelli ..... C25F 1/06 205/712
3,481,851 A * 12/1969 Lancy ..... C01G 37/033 205/486
3,535,213 A * 10/1970 Okada ..... C25D 11/38 205/178
3,632,389 A * 1/1972 Vazirani ..... C25D 11/38 428/418
3,832,292 A * 8/1974 Sutton ..... C25D 3/04 205/319
3,840,441 A * 10/1974 Hees ..... C23D 3/00 205/195
3,899,366 A * 8/1975 Tajkowski ..... B05D 5/083 428/470
5,330,850 A * 7/1994 Suzuki ..... C25D 3/565 428/623
2002/0033344 A1* 3/2002 Mabuchi ..... C25F 1/06 205/705
2015/0118518 A1* 4/2015 Sato ..... C25D 5/36 428/659

FOREIGN PATENT DOCUMENTS

JP S64036782 A * 2/1989
JP H08235751 A * 9/1996
KR 1999-0053993 7/1999
KR 10-2008-0057549 6/2008
KR 10-1536514 7/2015
KR 10-1718478 3/2017

OTHER PUBLICATIONS

Harada, Machine Translation, JP S64036782 A (Year: 1989).*
Morito et al., Machine Translation, JP-H08235751-A (Year: 1996).*
Lou et al., Electroplating, Encyclopedia of Chem. Proc. (Year: 2006).*

* cited by examiner

PASSIVATION SURFACE TREATMENT OF STAINLESS STEEL

CROSS-REFERENCE TO RELATED APPLICATION

This application is based on and claims priority under 35 U.S.C. § 119 to Korean Patent Application No. 10-2018-0001158 filed on Jan. 4, 2018, in the Korean Intellectual Property Office, the disclosure of which is incorporated herein by reference in its entirety.

BACKGROUND

1. Field of the Invention

The present disclosure relates to a passivation treatment method for securing corrosion resistance of stainless steel, and more particularly, to a method including electrolytic pickling, electrolytic degreasing and electrolytic passivation to improve corrosion resistance of stainless steel in a salted water condition without a change of the appearance of the stainless steel surface.

2. Discussion of Related Art

Stainless steel is a substance having beautiful surfaces and high corrosion resistance to be widely used for many purposes by utilizing its unique surfaces without conducting surface treatments, such as coating or painting. The stainless steel is often used as an exterior material of cooking appliances, refrigerators, washers, etc., to improve aesthetical sense of the exterior.

The reason that the stainless steel has corrosion resistance is that when the steel contains more than 12% of chrome, a dense protective film of 1 to 40 angstroms (Å) is naturally created on the surface, i.e., a chemically stable passive layer is formed on the surface, thus preventing future corrosion.

The existing immersion type passivation treatment for forming a passive film of the stainless steel includes degreasing, water washing, immersion passivation, water washing and drying processes, and a thin oxide film is formed on the surface in the passivation treatment process. The immersion type passivation treatment gives excellent corrosion resistance in the air, but has a problem with the corrosion resistance being lowered in various corrosive environments (brine environments, in particular) due to a hair line processing chip or foreign material depending on the washing state of the stainless steel.

On the other hand, electrolytic polishing is a method for polishing the surface by connecting a product to be polished to an anode and simultaneously, forming a thin oxide film on the surface. The electrolytic polishing method meets the corrosion resistance standard, but suffers from variation of roughness, color, and brightness of the surface as the surface is polished.

SUMMARY OF THE INVENTION

The present disclosure provides a passivation treatment method for stainless steel, which is capable of improving corrosion resistance including in a brine environment without changes of the appearance and gloss of the surface of stainless steel.

A passivation surface treatment method for stainless steel according to one aspect of the disclosed embodiments includes: performing degreasing of stainless steel; and performing electrolytic pickling where the stainless steel that underwent the degreasing is immersed in a pickling solution having phosphoric acid ($H_3PO_4$) and is connected to the anode and a voltage is applied over a time.

According to the method, the voltage applied may be about 0.5 to 5.0 V and the time is about 10 seconds or more, and a temperature of the picking solution is about 50 to 70° C.

The pickling solution further comprises sulfuric acid ($H_2SO_4$).

The pickling solution comprises less than about 70 to 100% by weight (wt %) of phosphoric acid ($H_3PO_4$) and less than about 30 wt % of sulfuric acid ($H_2SO_4$) (excluding 0).

The pickling solution further comprises chromic acid, glycerin, ammonium citrate and sodium nitrate as additives.

The voltage applied in the electrolytic pickling is about 1.5 to 5.0 V and the time is about 30 to 180 seconds.

The passivation surface treatment method for stainless steel further comprises: performing electrolytic passivation in which the stainless steel that underwent the electrolytic pickling is immersed in a passivation solution including dichromic acid and chromium sulfate and a voltage of about 0.5 to 5.0 V is applied for 5 seconds or more during the performing of the electrolytic passivation.

A passivation surface treatment method for stainless steel according to one aspect of the disclosed embodiments includes: performing electrolytic degreasing of stainless steel; and performing electrolytic passivation where the stainless steel that underwent the electrolytic degreasing is immersed in a passivation solution including dichromic acid and chromium sulfate and a voltage is applied over a time.

According to the method, the voltage applied may be about 0.5 to 5.0 V and the time is about 10 seconds or more, and a temperature of the passivation solution is about 50 to 70° C.

The pH of the passivation solution is about 3.5 to 5.5.

The passivation solution further comprises corrosion inhibitor.

The passivation solution comprises about 0.1 to 10.0% by weight (wt %) of dichromic acid, about 0.1 to 3.0 wt % of chromium sulfate, and about 5 wt % or less of corrosion inhibitor (excluding 0).

The voltage applied during the performing of electrolytic passivation is about 3.0 to 5.0 V and the time is about 60 to 180 seconds.

The passivation surface treatment method for stainless steel further comprises: electrolytic pickling in which the stainless steel is immersed in a pickling solution having phosphoric acid ($H_3PO_4$) and connected to the anode and a voltage of about 0.5 to 5.0 V for about 10 seconds or more is applied during the performing of the electrolytic pickling, before the electrolytic degreasing.

A passivation surface treatment method for stainless steel according to one aspect of the disclosed embodiments includes: performing degreasing of stainless steel; performing electrolytic pickling where the stainless steel that underwent the degreasing is immersed in a pickling solution having phosphoric acid ($H_3PO_4$) and is connected to the anode and a voltage of about 0.5 to 5.0 V for about 10 seconds or more is applied during the performing of the electrolytic pickling; performing electrolytic degreasing of the stainless steel; and performing electrolytic passivation where the stainless steel that underwent the electrolytic degreasing is immersed in a passivation solution including dichromic acid and chromium sulfate and a voltage of about 0.5 to 5.0 V is applied for 5 seconds or more during the performing of the electrolytic passivation.

The passivation surface treatment method for stainless steel further comprises: drying after the performing of the electrolytic passivation.

The passivation surface treatment method for stainless steel further comprises: water washing before and after the performing of the electrolytic pickling.

The passivation surface treatment method for stainless steel further comprises: neutralizing of sulfuric acid before and after the performing of the electrolytic passivation.

The passivation surface treatment method for stainless steel further comprises: water washing before and after the neutralizing of the sulfuric acid.

The passivation surface treatment method for stainless steel further comprises: creating a passive layer having the thickness of about 15 to 20 nm.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
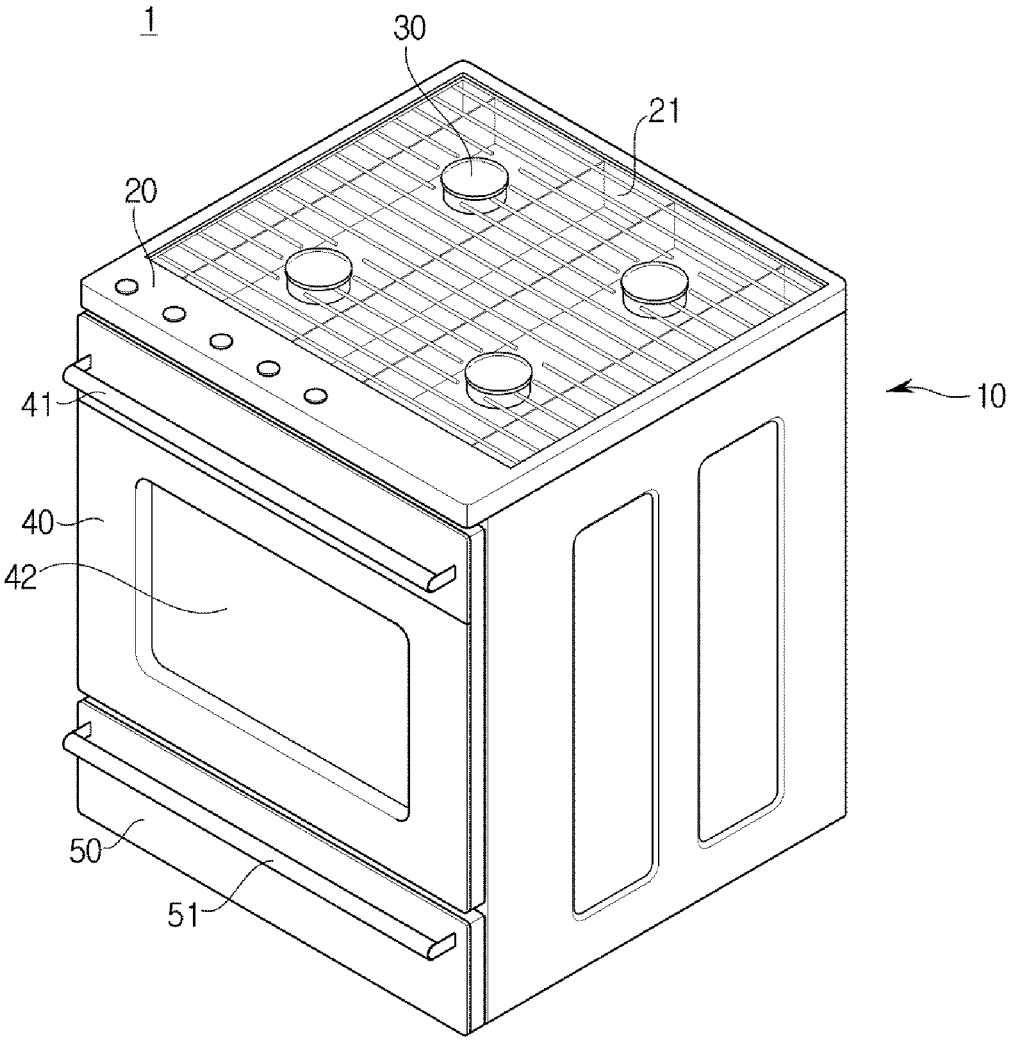
FIG. 1 shows a home appliance, according to an embodiment of the present disclosure.

Like numerals refer to like elements throughout the specification. Not all elements of embodiments of the present disclosure will be described, and description of what are commonly known in the art or what overlap each other in the embodiments will be omitted.

The term "include (or including)" or "comprise (or comprising)" is inclusive or open-ended and does not exclude additional, unrecited elements or method steps.

It is to be understood that the singular forms "a," "an," and "the" include plural references unless the context clearly dictates otherwise.

Reference will now be made in detail to embodiments, examples of which are illustrated in the accompanying drawings, wherein like reference numerals refer to the like elements throughout. A home appliance will be described first and a passivation surface treatment method for stainless steel will be described next.

The cooking appliance is herein taken as an example of a home appliance, but the present disclosure is not limited thereto. For example, embodiments of the present disclosure will also be applied to any outer material and home appliance having the outer material.

FIG. 1 shows a home appliance, according to an embodiment of the present disclosure.

In FIG. 1, the home appliance may include a main body 10 and heaters 30 for fueling cooking operation. The heaters 30 may be located on the top of the main body 10. Grills 21 may be provided between the heaters 30.

There is an oven provided in the main body 10 with an oven door 40 installed in the front to open or close the oven. The oven door 40 may include an oven handle 41 to be gripped by the user. The oven door 40 may have a window 42 for the user to look into the oven.

There may be a storage provided under the oven to store cooking utensils. The storage may be equipped with a storage door 50 to open or close the storage and a storage handle 51 to be gripped by the user.

The heaters 30 may be arranged to pierce the exterior material 20 applied on the top face of the main body 10. The exterior material 20 may include a passivated stainless steel.

Chrome (Cr), an essential composition of the stainless steel, has a dense oxide structure. When a chrome oxide is distributed on the surface of the stainless steel, it prevents oxygen from penetrating downward, forming a non-rusted area because no more oxidation occurs, and the chrome oxide layer is called a passivation (or passive) layer.

This makes the exterior material 20 of the home appliance not only look beautiful but also not easily corrode away even when heated for cooking or contacting moist because it has better corrosion resistance.

Accordingly, the exterior material of the home appliance in accordance with an embodiment of the present disclosure may be applied to cooking appliances. It is not, however, limited thereto, but may also be applied to washers, refrigerators, ovens, or dishwashers.

A passivation surface treatment method for stainless steel according to an embodiment of the present disclosure will now be described in detail.

Figure 2:
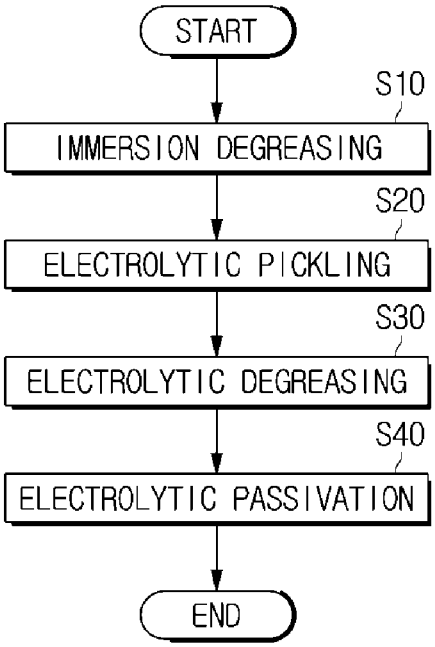
FIGS. 2 and 3 are flowcharts illustrating a passivation surface treatment method for stainless steel, according to an embodiment of the present disclosure.

FIG. 2 is a flowchart illustrating a passivation surface treatment method for stainless steel, according to an embodiment of the present disclosure.

Referring to FIG. 2, a passivation surface treatment method for stainless steel may include an immersion degreasing operation S10, an electrolytic pickling operation S20, an electrolytic degreasing operation S30, and an electrolytic passivation operation S40.

Figure 3:
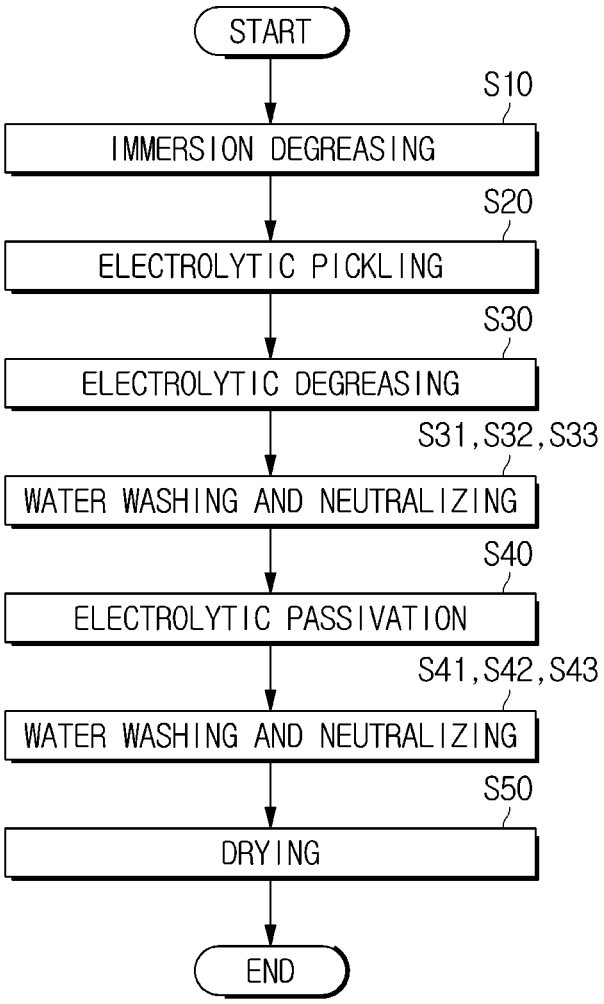

Referring to FIG. 3, a passivation surface treatment method for stainless steel may further include other steps as needed, such as a drying operation, a water washing operation, and a neutralization operation.

The immersion degreasing operation for cleaning the surface of the stainless steel by means of a degreasing solution is performed, in S10. The oil, organic substances and iron filings on the surface of the stainless steel may be removed by the immersion degreasing operation, thereby enabling the subsequent electrolytic pickling operation to be efficiently performed.

For the degreasing solution, an alkali degreasing solution may be used. The alkali degreasing solution may include a surfactant, a chelating agent, and the like. For the surfactant, one or more types may be selected from the group consisting of alkylarylsulfonate salt type or sulfuric acid ether type which is an anionic surfactant, alkylpyridinium salt which is a cationic surfactant, alkylimidazolinium salt, primary to tertiary aliphatic amine salt, imidazoline type amphoteric surfactant, bethaneine type, and nonionic surfactants.

For the chelating agent, one or more types may be selected from the group consisting of sodium tertiary phosphate, tripolyphosphate, sodium pyrophosphate, glucooxygen, and ethylenediaminetetraacetic acid (EDTA).

In the immersion degreasing operation, the oil (RCOOH) and the fatty acid ($3RCOOCH_2$) on the surface of the stainless steel are saponified with the alkali (NaOH) of the surfactant, emulsified/dispersed and separated from the surface of the stainless steel. Further, the chelating agent may form a coordinate bond with a metal ion to produce a chelate compounded, thereby solubilizing and removing metal contaminants.

The temperature of the degreasing solution may be about 30 to 60° C., and the immersion time may be about 1 to 30 minutes. The temperature of the degreasing solution may be preferably about 40 to 50° C., and the immersion time may be about 5 to 10 minutes.

After the immersion degreasing operation, a water washing process may be performed to clean out the degreasing solution in S11. Industrial water may be used for the water washing.

After the water washing process, a sponge cleaning process may be additionally performed to clean the surface of the stainless steel, in S12. In this regard, a sponge that makes no scratch on the surface of the stainless steel may be used.

Electrolytic pickling is performed, in S20.

In the case of general electrolytic polishing, a passive film is formed by applying a voltage equal to or higher than for the overpassivation region, but it arises a problem that the surface roughness is dropped to cause variation of the gloss.

In the present disclosure, excessive polishing of stainless steel is avoided by electrolytic pickling with optimum voltage and time, so not only the roughness (hair line) may be kept intact but also corrosion resistance may be secured as the passive film is formed.

Figure 4:
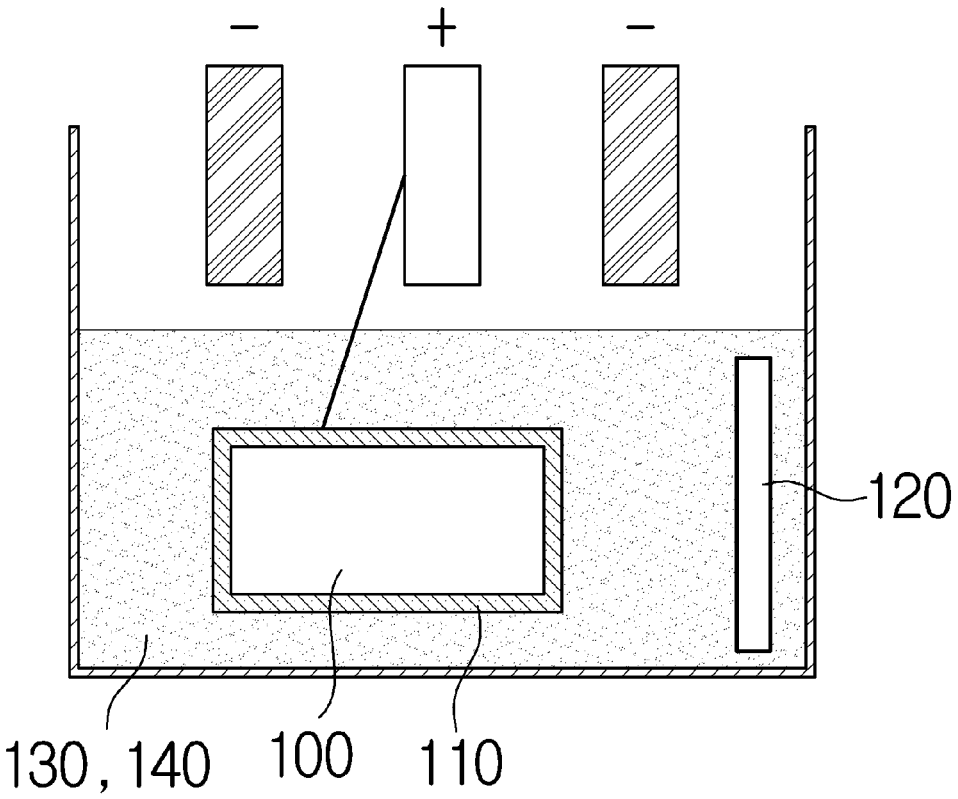
FIG. 4 is a schematic diagram of passivation surface treatment of stainless steel, according to an embodiment of the present disclosure.

FIG. 4 is a schematic diagram of electrolytic pickling of stainless steel, according to an embodiment of the present disclosure. Specifically, stainless steel 100 may be mounted in a jig 110, and connected to the anode while the counter electrode is connected to the cathode, and a voltage may then be applied to a pickling solution 130. Copper bus bars may be used for the electrodes (anode and cathode). In addition, a temperature controller 120 may be used to control the temperature of the pickling solution 130.

Electrolytic pickling may be performed using the acidic solution in which phosphoric acid ($H_3PO_4$) and sulfuric acid ($H_2SO_4$) are mixed.

The pickling solution may contain about 70 to 100% by weight of phosphoric acid and about 0 to 30% by weight of sulfuric acid. Furthermore, the pickling solution may further contain chromic acid, glycerin, ammonium citrate and sodium nitrate as additives.

If the content of sulfuric acid exceeds about 30% by weight, the surface roughness increases due to excessive erosion of the stainless steel, and corrosion resistance may be undesirably reduced. On the contrary, if the amount of sulfuric acid is too small, there is a disadvantage that the activity of the solution is lowered to delay the treatment time. On the other hand, the gloss, flatness, roughness, etc., of the surface of the stainless steel may be controlled by properly regulating the amount of the additive.

In the electrolytic pickling operation, anodic oxidation in the electrolytic pickling solution may properly polish the surface of the stainless steel to remove foreign matter and fine scratches and to even minimize variations of gloss.

For this, a voltage of about 0.5 to 5.0 V may be applied for about 10 seconds or more in the electrolytic pickling operation. Preferably, a voltage of about 1.5 to 5 V may be applied for about 30 to 180 seconds in the electrolytic pickling operation. Furthermore, the voltage may be regulated according to the surface area of the product.

When the voltage is less than about 0.5 V or the pickling treatment time is less than about 10 seconds, it is difficult to remove foreign matter or defects that may cause corrosion of the surface. On the contrary, when the voltage exceeds about 5 V or the pickling time exceeds about 180 seconds, the surface roughness is excessively reduced due to the excessive polishing effect, so that the senses of luminance and hair line texture, which are unique to stainless steel, may not be utilized, which is not desirable.

Moreover, the temperature of the pickling solution may be about 50 to 70° C. Preferably, the temperature of the pickling solution may be about 50 to 66° C.

When the temperature of the pickling solution is less than about 50° C., it is difficult to obtain the effect of electrolytic polishing such as removal of foreign substances and the efficiency of electrolytic polishing is low, and when the temperature of the pickling solution exceeds about 70° C., the brightness increases, degrading the unique metal sense of the stainless steel, increasing the processing cost, and having a problem with work stability.

After the electrolytic pickling operation, a water washing process may be performed to clean out the pickling solution, in S21. Industrial water may be used for the water washing.

Degreasing is performed, in S30. According to an embodiment of the present disclosure, degreasing may be performed in an electrolytic degreasing manner.

For the degreasing solution, an alkali degreasing agent may be used.

The alkali degreasing solution may include a surfactant, a chelating agent, and/or the like. For the surfactant, one or more types may be selected from the group consisting of alkylarylsulfonate salt type or sulfuric acid ether type which is an anionic surfactant, alkylpyridinium salt which is a cationic surfactant, alkylimidazolinium salt, primary to tertiary aliphatic amine salt, imidazoline type amphoteric surfactant, bethaneine type, and nonionic surfactants.

For the chelating agent, one or more types may be selected from the group consisting of sodium tertiary phosphate, tripolyphosphate, sodium pyrophosphate, glucooxygen, and ethylenediaminetetraacetic acid (EDTA).

The electrolytic degreasing operation may be carried out at a voltage of about 4.0 to 9.0 V and at a temperature of about 30 to 60° C. for about 10 to 60 seconds in consideration of the water spreadability on the surface after degreasing. Preferably, the electrolytic degreasing operation may be carried out at a voltage of about 4.0 to 8.0 V and at a temperature of about 40 to 50° C. for about 20 to 40 seconds.

Figure 5:
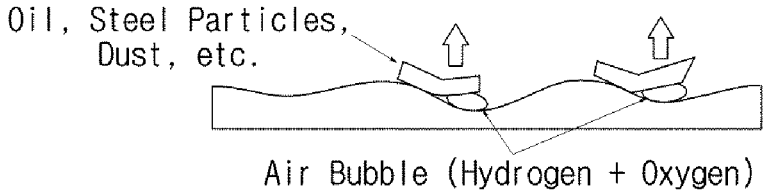
FIG. 5 shows a principle of removing impurities in an electrolytic degreasing operation.

FIG. 5 shows a principle of removing impurities in an electrolytic degreasing operation.

In the embodiment of the present disclosure, a gas is produced by introducing the electrolytic degreasing method instead of the conventional immersion degreasing. Specifically, the reactions of $4H_2O+4e^- \rightarrow 4OH+2H_2$ and $4OH^- \rightarrow 2H_2O+O_2+4e^-$ occur at the cathode and the anode, respectively.

As the hydrogen ($H_2$) and oxygen ($O_2$) are produced, not only the degreasing solution may be stirred but also the oil, fine iron particles, dust and the like, on the surface of the stainless steel rise together to remove impurities or contaminants and activate the surface of the stainless steel.

Subsequently, additional water washing and pickling may be alternately performed. Industrial water may be used for water washing. To clean out the alkali degreasing solution, second water washing is performed, in S31, and sulfuric acid pickling may be performed for neutralization, in S32. For the pickling solution, about 1 to 10 vol % solution of sulfuric acid ($H_2SO_4$) may be used, the purity of the sulfuric acid being about 98%, and the sulfuric acid pickling may be performed at room temperature for about 5 seconds or more. Additional third water washing may be performed to clean out the pickling solution, S33.

Subsequently, an electrolytic passivation for forming a metal oxide film on the surface of the stainless steel is performed, in S40.

FIG. 4 is a schematic diagram of electrolytic passivation of stainless steel, according to an embodiment of the present disclosure. Specifically, the stainless steel 100 may be mounted in the jig 110, and connected to an electrode to apply a voltage to a passivation solution 140. Copper bus bars may be used for the electrodes (anode and cathode). In addition, the temperature controller 120 may be used to control the temperature of the passivation solution 140.

The electrolytic passivation may be performed using the passivation solution 140 containing a mixture of dichromic acid, chromium sulfate, corrosion inhibitor and distilled water.

The passivation solution may include about 0.1 to 10.0% by weight (wt %) of dichromic acid, about 0.1 to 3 wt % of chromium sulfate, about 5 wt % or less of corrosion inhibitor (excluding 0), and remainder water.

When the content of dichromic acid is less than about 0.1 wt %, passivation is difficult, and when it is more than about 10.0 wt %, the surface of stainless steel is damaged and corrosion resistance is lowered.

If the content of chromium sulphate is less than about 0.1 wt %, the solution activity is lowered to make passivation difficult, and when the content of chromium sulphate is more than about 3.0 wt %, the surface brightness of the product increases, failing to serve the purpose of use.

The corrosion inhibitor prevents adsorption and erosion of the Fe component contained in the stainless steel and assists in formation of a passive film. If an excessive amount of the corrosion inhibitor is added, it hinders the formation of the passive film, so the upper limit may be confined to about 5 wt %.

In an embodiment, the electrolytic passivation solution may include a dichromic acid, a chromium sulfate, and a corrosion inhibitor, and the total concentration may be maintained at about 10 to 20%.

In the electrolytic passivation operation of the present disclosure, a chromating effect may be obtained when stainless steel is attached to a negative electrode.

Specifically, the reaction formula is as follows.

$$H_2Cr_2O_7 \rightarrow 2H^+ + Cr_2O_7^{2-}$$

$$Cr_2O_7^{2-} + 14H^+ + 6e \rightarrow 2Cr^{3+} + 7H_2O$$

$$Cr_2O_7^{2-} + 2Cr^{3+} + 3H_2O \rightarrow Cr_2O_3 + 2CrOHCrO_4 + 4H^+$$

Through the oxidation reactions, the corrosion resistance of the stainless steel may be improved by forming a metal oxide film which is more solid, dense and stable than the passive film formed on the surface of the stainless steel in a natural state.

For this, a voltage of about 0.5 to 5.0 V may be applied for about 5 seconds or more in the electrolytic passivation operation. Preferably, a voltage of about 3.0 to 5 V may be applied for about 60 to 180 seconds in the electrolytic passivation operation.

When the voltage is less than about 0.5 V or the passivation time is less than about 5 seconds, it is difficult to make a thin passivation film and to increase the chromium (Cr) oxide content. On the contrary, when the voltage exceeds about 5 V or the passivation time exceeds about 180 seconds, there is a problem with the processing costs that rise due to the increase of the immersion time.

Also, the temperature of the passivation solution may be about 50 to 70° C. and the pH may be about 3.5 to 5.5. Preferably, the pH of the passive solution may be about 4.0 to 5.0.

If the temperature of the passivation solution is less than about 50° C., the time required to form the passive film becomes long, thus lowering the productivity. On the contrary, when the temperature of the passivation solution exceeds about 70° C., the surface of the stainless steel is damaged and the corrosion resistance is lowered.

When the pH is lower than the aforementioned range, sodium hydroxide (NaOH) is added, and when the pH is higher, the pH may be adjusted by adding a passivation solution.

Subsequently, additional water washing and pickling may be alternately performed. Industrial water may be used for water washing. To clean out the passivation solution, third water washing is performed, in S41, and sulfuric acid pickling may be performed for neutralization, in S42. For the pickling solution, about 1 to 10 vol % solution of sulfuric acid ($H_2SO_4$) may be used, the purity of the sulfuric acid being about 98%, and the sulfuric acid pickling may be performed at room temperature for about 5 seconds or more. Additional third water washing may be performed to clean out the neutralization solution, in S43.

Subsequently, additional hot water washing may be performed in S44. Industrial water may be used for water washing, and the temperature may be about 50 to 90° C. and the immersion time may be about 5 seconds or more.

Subsequently, additional water washing may be performed in S45. Industrial water may be used for water washing.

Thereafter, additional washing may be performed using distilled water for about 5 seconds or more in S46.

Moisture on the surface of the stainless steel may be removed by using air while the stainless steel is mounted on a rack, in S47.

Drying is performed, in S50. In an embodiment, hot air drying may be performed to remove moisture from the surface of the stainless steel. Hot air drying may be carried out at a temperature of about 65° C. or higher for about 10 to 30 minutes.

The thickness of the passive layer formed on the surface of the stainless steel through the aforementioned series of steps is about 15 to 20 nm.

Hereinafter, the experimental results from testing the corrosion resistance of the stainless steel (STS304), to which the passive surface treatment method according to the embodiment of the present disclosure is applied, will now be described.

Example 1 vs. Comparative Examples 1 and 2

Figure 6:
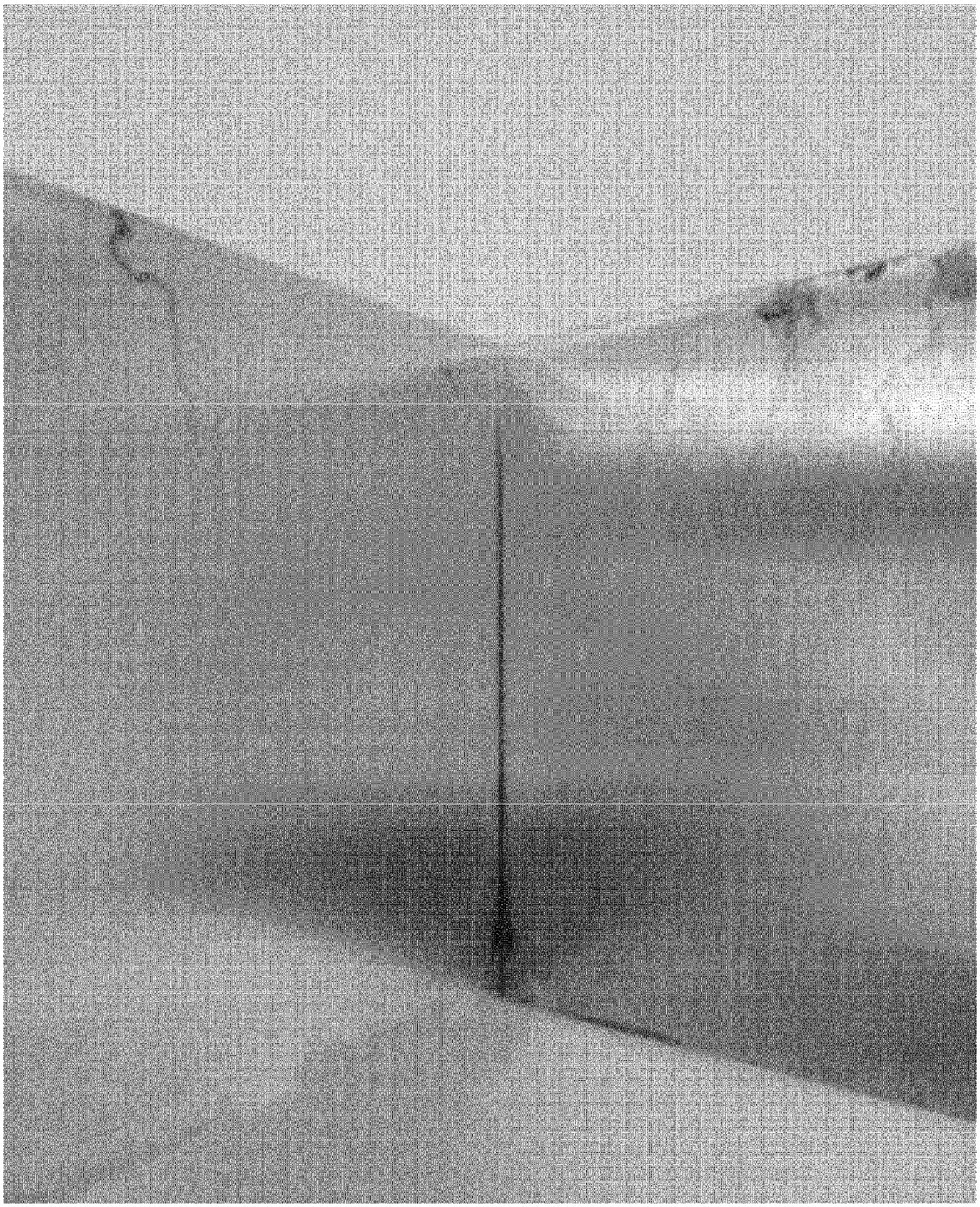
FIG. 6 is a photograph showing stainless steel to which passivation treatment is not applied, after a salted water spraying test is done on the stainless steel.
Figure 7:
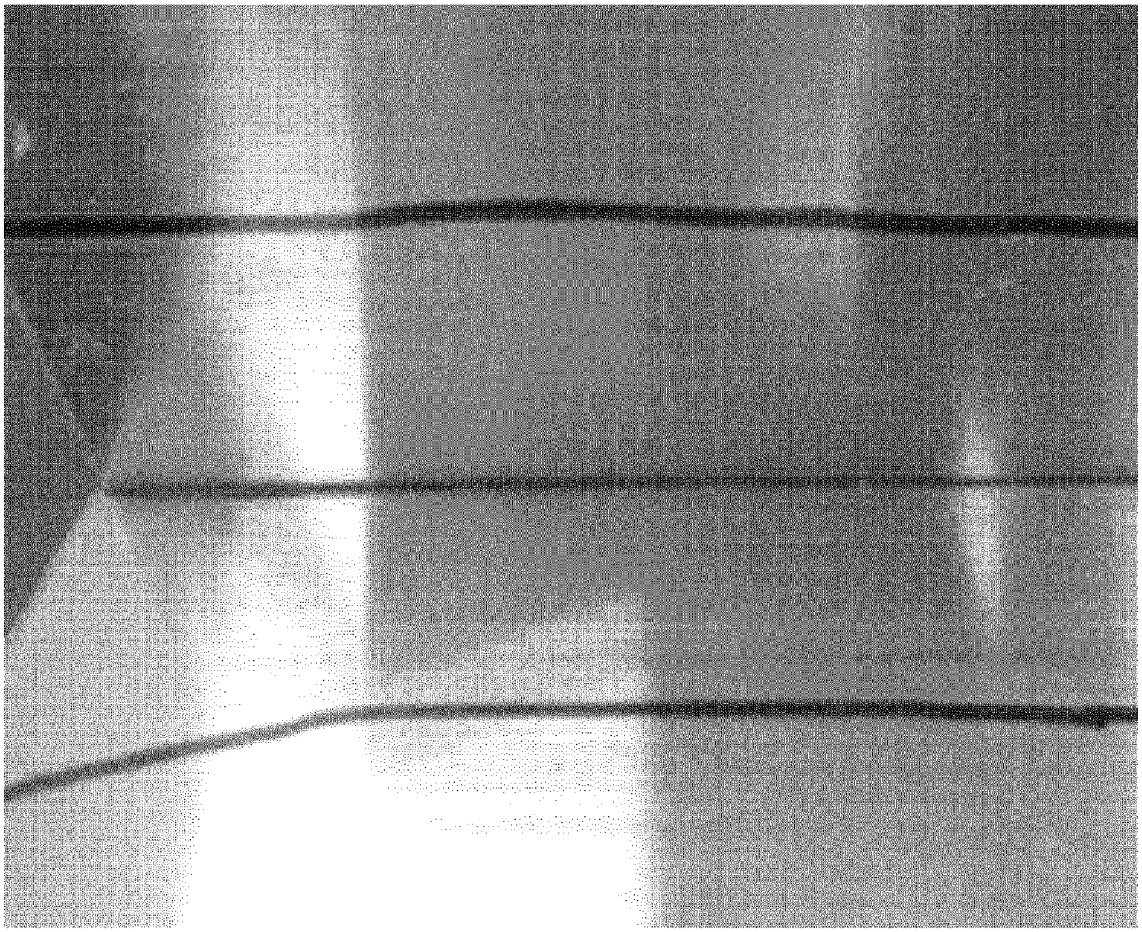
FIGS. 7 and 8 are photographs showing stainless steel to which conventional immersion passivation treatment is applied, after a salted water spraying test is done on the stainless steel.
Figure 8:
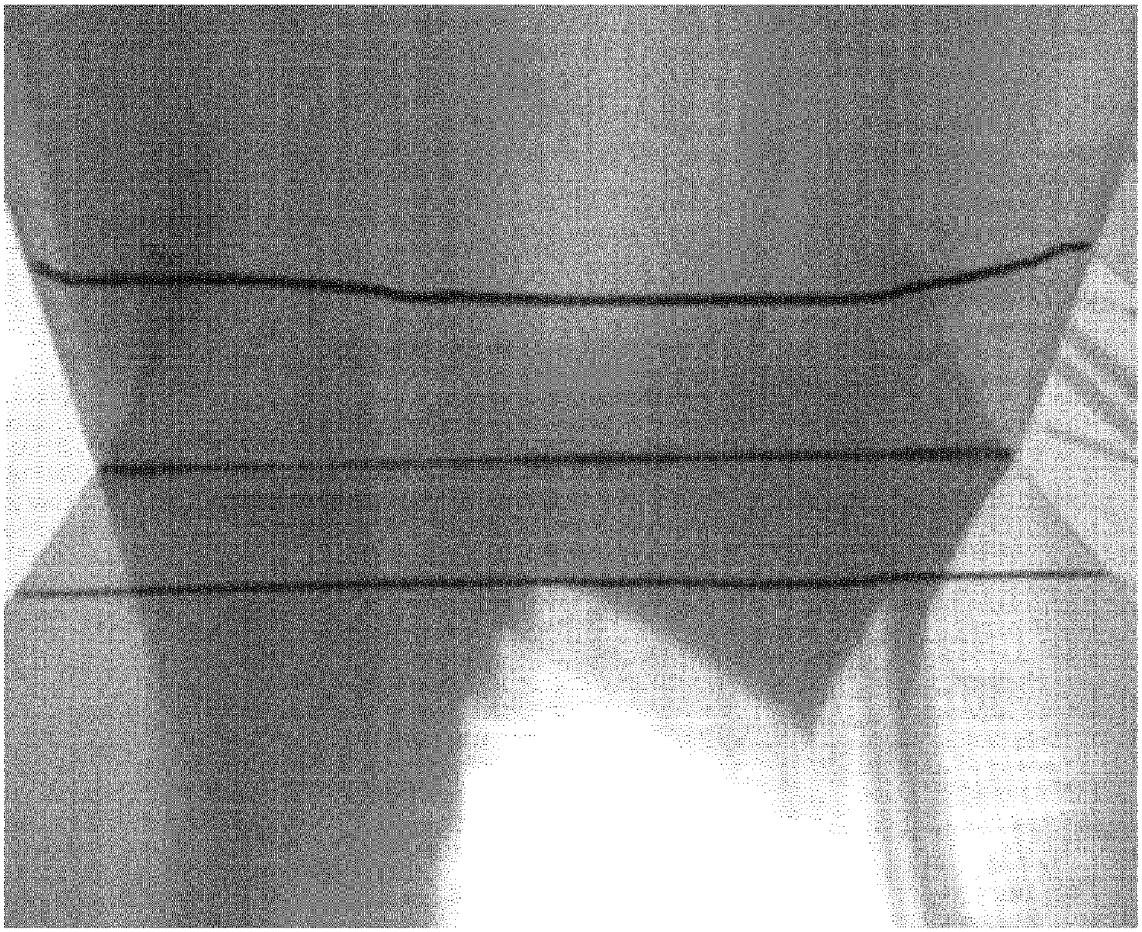
Figure 9:
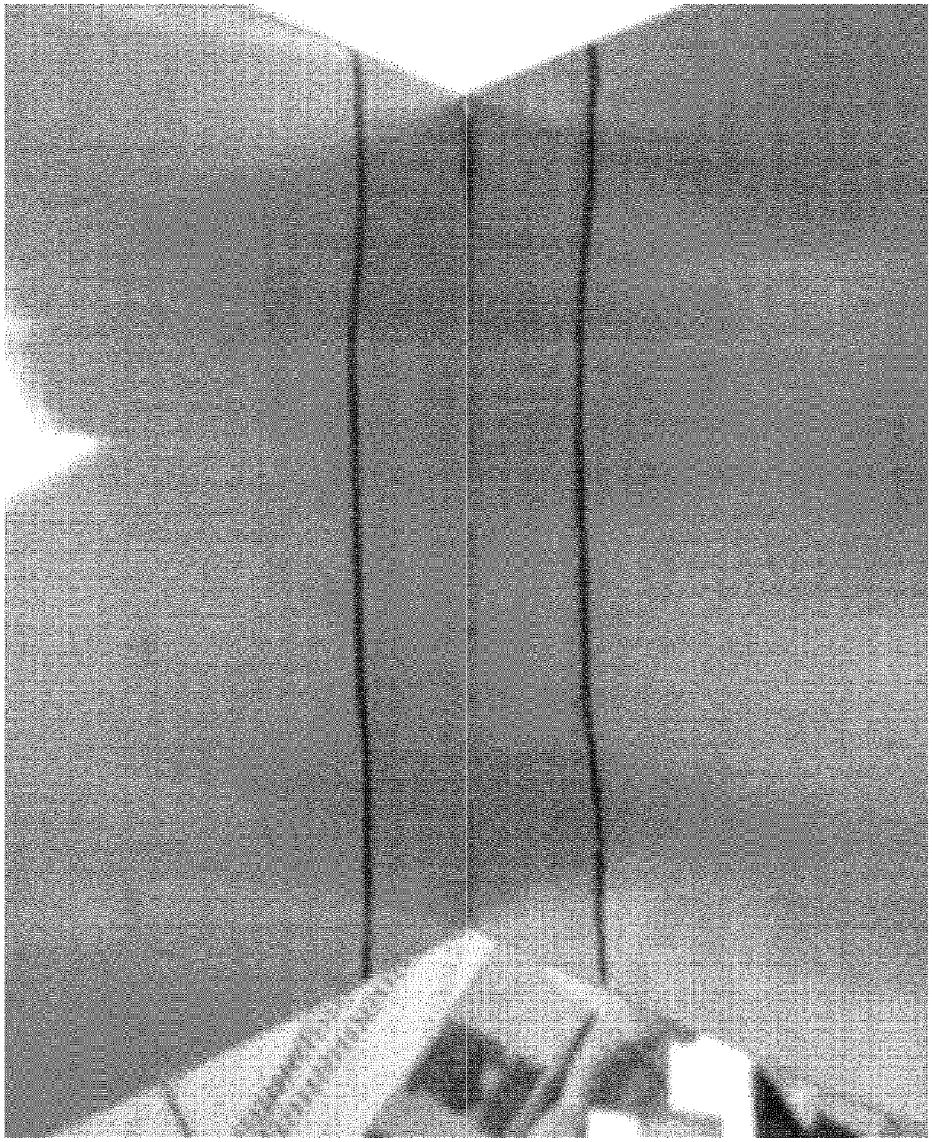
FIG. 9 is a photograph showing stainless steel to which passivation treatment according to an embodiment of the present disclosure is applied, after a salted water spraying test is done on the stainless steel.

FIG. 6 is a photograph showing a welded portion after a salted water spraying test is performed on stainless steel to which passivation treatment is not applied. FIGS. 7 and 8 are photographs showing welded portions after a salted water spraying test is performed on stainless steel to which the conventional immersion passivation treatment is applied. FIG. 9 is a photograph showing a welded portion after a salted water spraying test is performed on stainless steel to which passivation treatment in accordance with an embodiment of the present disclosure is applied.

Ten cycles of the salted water spraying test were carried out in a chamber under the temperature condition of about 35° C., and in each cycle, a 5% solution of sodium chloride (NaCl) was sprayed to each sample for about 8 hours and stopped for about 16 hours.

Referring to FIG. 6, in the case of the stainless steel with no passivation treatment applied thereto, it is seen that the surface of the stainless steel was rusted after one cycle of salted water spraying.

Referring to FIG. 7, in the case of the stainless steel with conventional immersion passivation treatment applied thereto, it is seen that tiny rust was created on the surface of the stainless steel after two cycles of salted water spraying.

Referring to FIG. 8, in the case of the stainless steel with conventional immersion passivation treatment applied thereto, it is seen that the welding portion began to rust after ten cycles of salted water spraying.

Referring to FIG. 9, it is seen that the stainless steel with passivation surface treatment in accordance with an embodiment of the present disclosure applied thereto was not rusted and had no change in the appearance even after 10 cycles of salted water spraying.

Figure 10:
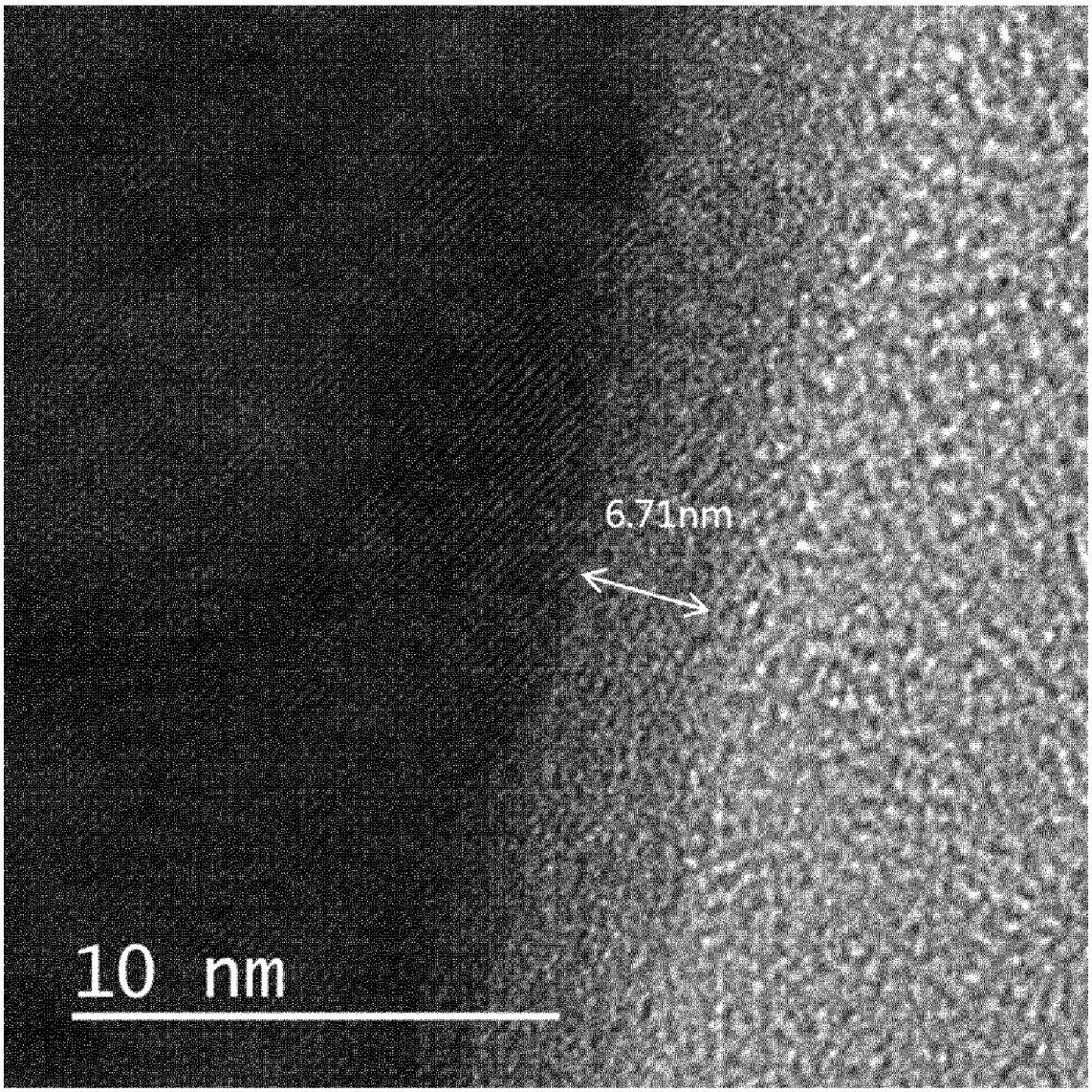
FIG. 10 is a transmission electron microscopy (TEM) cross-sectional picture of stainless steel before passivation surface treatment is applied thereto.
Figure 11:
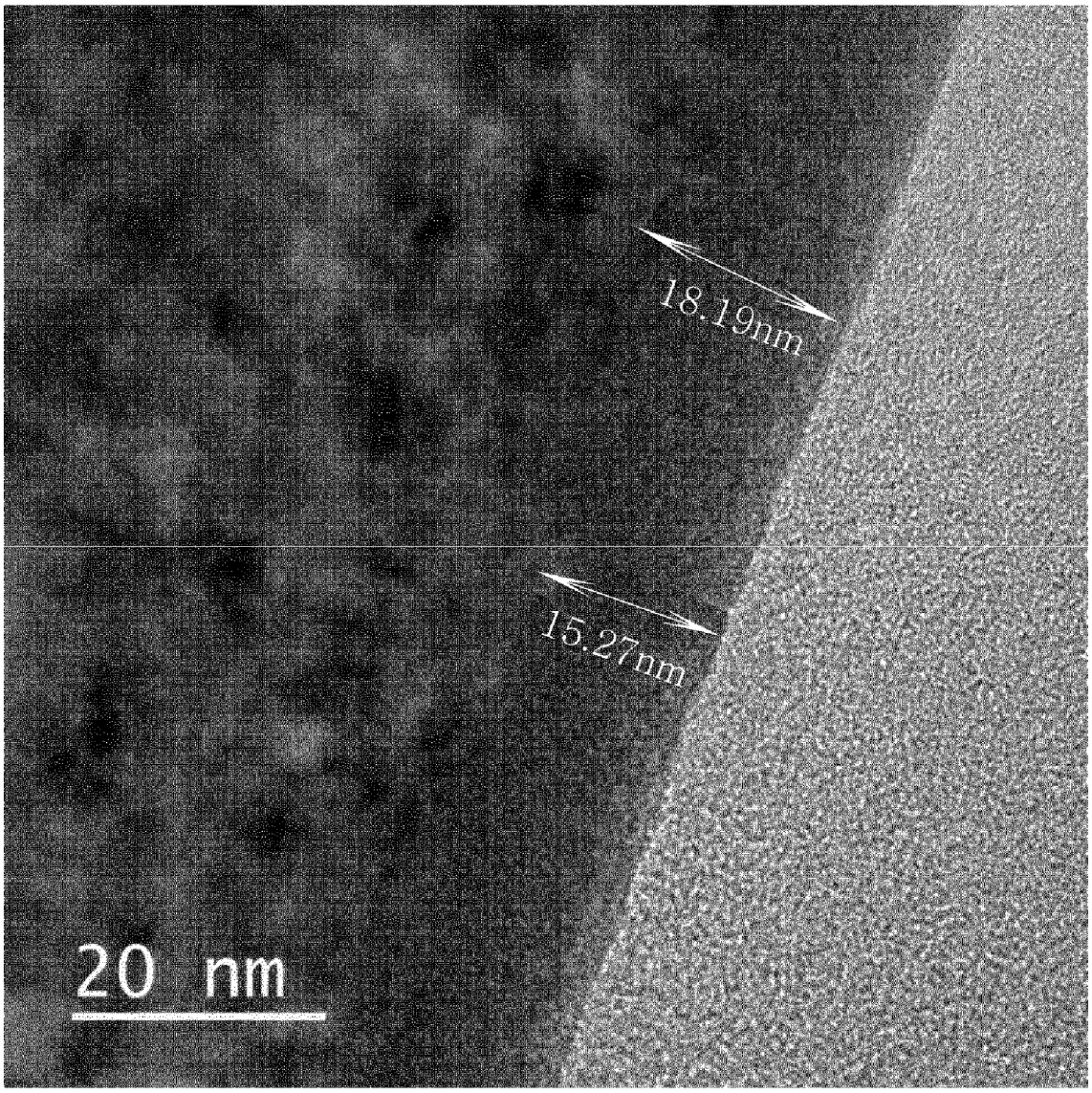
FIG. 11 is a TEM cross-sectional picture of stainless steel after passivation surface treatment is applied thereto, according to an embodiment of the present disclosure.

FIGS. 10 and 11 are transmission electron microscopy (TEM) cross-sectional photographs of stainless steel before and after passivation surface treatment according to an embodiment of the present disclosure is applied, respectively. Referring to FIG. 11, it is seen that a passive film of about 18.19 nm was formed.

In the embodiment of the present disclosure, the passivation surface treatment method for stainless steel includes electrolytic pickling and electrolytic passivation steps, which are wet methods, so that the processing cost may be saved as compared with mechanical polishing such as buffing.

In addition, the passivation surface treatment method of stainless steel according to the embodiment of the present disclosure may improve the corrosion resistance in the salted water condition without a change of appearance of the surface of stainless steel.

According to embodiments of the present disclosure, a passivation surface treatment method for stainless steel may improve corrosion resistance in a brine environment without a change of the appearance of the surface of stainless steel.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A method of passivation surface treatment for stainless steel, the method comprising:

performing electrolytic pickling by immersing the stainless steel that underwent degreasing in a pickling solution having phosphoric acid ($H_3PO_4$) while the stainless steel is connected to an anode and applying a voltage of between 0.5 to 5.0 V to the pickling solution during a time of between 30 to 180 seconds;

performing electrolytic degreasing of the stainless steel;

neutralizing an alkaline degreasing solution used for the electrolytic degreasing with sulfuric acid;

performing electrolytic passivation by immersing the stainless steel that underwent the electrolytic degreasing in a passivation solution including dichromic acid and chromium sulfate while applying a voltage over a time; and pickling the stainless steel with sulfuric acid, wherein the passivation solution comprises between 0.1 to 10.0% by weight (wt %) of dichromic acid, between 0.1 to 3.0 wt % of chromium sulfate, and 5 wt % or less of corrosion inhibitor (excluding 0).

2. The method of claim 1, wherein a temperature of the pickling solution is between 50 to 70° C.

3. The method of claim 1, wherein the pickling solution further comprises sulfuric acid ($H_2SO_4$).

4. The method of claim 3, wherein the pickling solution comprises phosphoric acid ($H_3PO_4$) equal to or more than 70% by weight and less than 100% by weight and sulfuric acid ($H_2SO_4$) more than 0% by weight and equal to or less than 30% by weight.

5. The method of claim 3, wherein the pickling solution further comprises chromic acid, glycerin, ammonium citrate and sodium nitrate as additives.

6. The method of claim 1, wherein a temperature of the passivation solution is between 50 to 70° C.

7. The method of claim 1, wherein a pH of the passivation solution is between 3.5 to 5.5.

8. The method of claim 1, wherein the voltage applied during the performing of the electrolytic passivation is between 3.0 to 5.0 V and the time is between 60 to 180 seconds.

9. A method of passivation surface treatment for stainless steel, the method comprising:

performing immersion degreasing of stainless steel;

performing electrolytic pickling by immersing the stainless steel that underwent the immersion degreasing in a pickling solution having phosphoric acid ($H_3PO_4$) while the stainless steel is connected to an anode and applying a voltage between 0.5 to 5.0 V to the pickling solution during a time of 30 to 180 seconds;

performing electrolytic degreasing of the stainless steel;

neutralizing an alkaline degreasing solution used for the electrolytic degreasing with sulfuric acid;

performing electrolytic passivation where the stainless steel that underwent the electrolytic degreasing is immersed in a passivation solution including dichromic acid and chromium sulfate and applying a voltage between 0.5 to 5.0 V for 5 seconds or more during the performing of the electrolytic passivation; and pickling the stainless steel with sulfuric acid;

wherein the passivation solution comprises between 0.1 to 10.0% by weight (wt %) of dichromic acid, between 0.1 to 3.0 wt % of chromium sulfate, and 5 wt % or less of corrosion inhibitor (excluding 0).

10. The method of claim 9, further comprising: drying after the performing of the electrolytic passivation.

11. The method of claim 9, further comprising: water washing before and after the performing of the electrolytic pickling.

12. The method of claim 9, further comprising: creating a passive layer having a thickness of between 15 to 20 nm.

* * * * *